US005743594A

United States Patent [19]

Suskey et al.

[11] Patent Number: 5,743,594

[45] Date of Patent: Apr. 28, 1998

[54] SUPINE RECLINER AND MECHANISM

[75] Inventors: Wesley D. Suskey; Todd S. Zeier, both of Sheboygan; Randall L. Dorner, Howards Grove, all of Wis.

[73] Assignee: Nemschoff Chairs, Inc., Sheboygan, Wis.

[21] Appl. No.: 445,693

[22] Filed: May 22, 1995

Related U.S. Application Data

[63] Continuation-in-part of Ser. No. 446,916, Apr. 10, 1995.

[51] Int. Cl.[6] ..... B60N 2/02

[52] U.S. Cl. ..... 297/354.13

[58] Field of Search ..... 297/356, 357, 297/354.13, 383, 354.12, 64–66, 118, 463.1; 5/12.1, 41, 47, 18.1

[56] References Cited

U.S. PATENT DOCUMENTS

| | | | |
|---|---|---|---|
| 82,482 | 9/1868 | Blood | 297/354.13 X |
| 1,729,687 | 10/1929 | Savage | 297/357 |
| 2,042,886 | 6/1936 | Ferguson | 297/357 X |
| 2,089,867 | 8/1937 | Welch | 297/357 |
| 2,486,716 | 11/1949 | Kuebler | 297/357 |
| 2,634,796 | 4/1953 | Fischer | 297/343 |
| 2,661,047 | 12/1953 | Blanken | 297/65 |
| 2,937,384 | 5/1960 | Fossum | 5/18.1 |
| 2,997,340 | 8/1961 | Poskin | 297/364 X |
| 3,385,631 | 5/1968 | Gertler . | |
| 3,913,152 | 10/1975 | Quakenbush . | |
| 4,018,166 | 4/1977 | Gutridge et al. | 297/343 X |
| 4,099,275 | 7/1978 | Pallan . | |
| 4,204,287 | 5/1980 | Lane et al. . | |
| 4,221,428 | 9/1980 | Bowman et al. . | |
| 4,366,585 | 1/1983 | Ponti et al. . | |
| 4,458,941 | 7/1984 | Venable | 297/357 X |
| 4,481,684 | 11/1984 | Hauck . | |
| 4,586,206 | 5/1986 | Singer . | |
| 4,762,364 | 8/1988 | Young | 297/364 X |
| 4,862,529 | 9/1989 | Peck . | |
| 5,101,524 | 4/1992 | Brandschain . | |
| 5,137,328 | 8/1992 | Smith et al. . | |

*Primary Examiner*—Milton Nelson, Jr.
*Attorney, Agent, or Firm*—Reinhart, Boerner, Van Deuren, Norris & Rieselbach, s.c.

[57] ABSTRACT

An extendable chair and mechanism for use therewith to provide a wall proximate horizontal rest surface. A two or three-support surface is available through extension of an attractive upright chair.

24 Claims, 16 Drawing Sheets

SUPINE RECLINER AND MECHANISM

This is a continuation-in-part of copending application Ser. No. 08/446,916 filed on Apr. 10, 1995.

This invention relates generally to multi-function chair articles and, more particularly, to chairs having extensible mechanisms which operate to move the seat portion of such a chair to a position distal from the backrest portion when the chair is converted to a supine sleeping surface.

Typically, reclinable chairs do not extend to a completely horizontal resting surface. The extending and tilting linkages/mechanisms utilized are limited to the extent that the backrest and seat portions are about 15–30 degrees from fully horizontal. The surface so obtained is less than optimal for a variety of reasons. Long periods of restful sleep are often not possible. Even so, the oblique backrest-seat angle inherent to such mechanisms presents disadvantages for those experiencing lower back and associated ailments or those accustomed to a variety of sleeping positions.

As mentioned above, reclinable chairs of the prior art incorporate various extending and tilting linkages to achieve one or more reclined positions. The hinged or coupled joints of such linkages are often exposed and, upon closing, present a hazard to the unwary. Furthermore, these linkages are comprised of numerous movable parts, and the failure of any would cause malfunction of the entire linkage.

Several reclinable chairs of the prior art have standard telescopic mechanisms which necessitate inconvenient cushion rearrangement upon conversion. The requisite degree of comfort and aesthetics in both the sitting and reclining positions is seldom provided. Furthermore, such chairs do not utilize the backrest portion as part of the sleeping surface and, as a result, tend to occupy an inordinate amount of floor space.

In summary, the prior art has associated with it a number of significant drawbacks. Most are related to performance and positional deficiencies and result from the type of extending and tilting mechanisms currently employed. There is a proven need for an alternative convertible chair article and an extending mechanism for use in conjunction therewith to afford a fully supine sleeping surface.

OBJECTS OF THE INVENTION

It is an object of the present invention to overcome the problems and deficiencies of the prior art, including those described above.

It is another object of the present invention to provide a chair and extensible mechanism which can be used in conjunction herewith to reversibly convert the article chair from a sitting to a supine rest position.

It is an object of the present invention to provide an upright chair convertible to a supine sleeping surface which when contracted provides a seat portion angled acutely with respect to a corresponding backrest.

It is an object of the present invention to provide a mechanism usable in conjunction with a convertible chair which imparts to the chair various wall-proximate characteristics upon reversible conversion to a supine and/or horizontal position.

It is an object of the present invention to provide an extendable chair with removable arms and/or comparable side supports such that the chair can be moved, transported, or otherwise relocated with a smaller width dimension without interrupting function of the chair extension mechanism.

It is an object of the present invention to provide an extensible mechanism for use with a convertible chair article such that the cushion members, cushion covers and arms and/or side supports of such a chair can be removed for cleaning or repair without interrupting the function of the chair extension mechanism.

It is an object of the present invention to provide an extendable chair and mechanism for chair extension that can be adapted or modified, without interrupting or substantially changing mechanism function, to incorporate various other components.

It is an object of the present invention to provide an extensible mechanism for use with an extendable chair such that the backrest of the chair is movable with the extensible mechanism.

It is an object of the present invention to provide a non-coplanar mechanism usable in conjunction with a convertible chair whereby extension of the mechanism brings an angled seat portion into planar alignment with other chair support portions in forming a horizontal resting surface.

It is an object of the present invention to provide a mechanism usable and in conjunction with a convertible chair which minimizes the injury potential associated with mechanism retraction.

It is an object of the present invention to provide a mechanism useful in conjunction with a convertible chair such that the seat portion of such a chair can be moved to a position distal to the backrest to permit the seat and backrest portions to become co-planar components of a horizontal sleeping surface.

It is an object of this invention to provide an extensible mechanism which can be used with or without a wheel base assembly or other such component(s) which assist in movement and/or placement of a convertible chair.

It is an object of this invention to provide a back rest and/or support member for use with a convertible, extensible chair which provides more than one-half of a horizontal rest surface upon conversion.

It is an object of this invention to provide an extensible mechanism of the kind which can be extended upon lifting the seat and/or forwardmost portion of the chair upward and/or forward.

It is an object of this invention to provide a pivotable back support portion which when the chair is converted and/or extended is adjacent to the seat member.

It shall be understood that with respect to any one embodiment of the invention these objects can be considered in the alternative. Other objects, features and advantages of the present invention will be readily apparent from the following description of the preferred embodiments thereof, taken in conjunction with the accompanying examples and figures.

SUMMARY OF THE INVENTION

In part, the present invention is a mechanism for use with chairs and related articles of the type having seat and back rests extendable to a sleeping position and retractable to a sitting position, including (1) a substantially stationary frame having an interior cross dimension; (2) a frame movable from the stationary member and having an exterior cross dimension less than that of the stationary frame; and (3) a connector between the stationary and movable frames having a plurality of non-coplanar extensible members, such that one extensible member slidably engages the stationary frame and another extensible member slidably engages the movable frame.

In preferred embodiments, the extensible members have a pair of two interengaging linear members, and each interengaging linear member of the pair slidably engages the other linear member. In highly preferred embodiments, each linear member of each pair has a complementary track member for slidable engagement with the other linear member. Likewise, one complementary track member receives the other complementary track member, and the receptive track member has vertically aligned portions dimensioned to receive the other track member.

In highly preferred embodiments, one interengaging linear member of each pair also slidably engages the stationary frame, while one interengaging linear member of each pair also slidably engages the movable frame. Each linear member of each of the pairs has a track member for slidable engagement with one of the stationary and movable frames. The movable frame has a pair of sidewalls, each of which has vertically aligned portions dimensioned to receive a linear member. The sidewalls are interposable between the stationary frame and the connector upon retracting the mechanism. Alternatively, the interengaging linear members are juxtaposed one to the other. Each linear member of each pair slidably engages the other linear member. One linear member of each pair slidably engages the stationary frame, and one linear member of each pair slidably engages the movable frame.

In part, the present invention is an extendable chair, including (1) a seat, backrest and support member interposable between the seat and backrest, such that the seat, backrest and support member are movable between upright and supine positions; (2) a stationary frame having an interior cross dimension; (3) a movable frame having an exterior cross dimension less than that of the stationary frame; and (4) a connector between the stationary and movable frames, the connector having a plurality of non-coplanar extensible members, one extensible member slidably engaging the stationary frame and another extensible member slidably engaging the movable frame, such that the movable frame is positioned between the stationary frame and connector when the chair is in an upright sitting position.

In preferred embodiments, the extensible members have a pair of two interengaging linear members. One linear member of the pair slidably engages the other linear member. In a similar fashion, one interengaging linear member of each pair slidably engages the stationary frame, and one interengaging linear member of each pair slidably engages the movable frame.

In highly preferred embodiments, the stationary member has a pair of spaced sidewalls. The seat is mounted to the movable frame, such that the seat and movable frame together have a unit dimension less than the interior cross dimension of the stationary frame. Likewise, in highly preferred embodiments, the support member is pivotably attached to the movable frame such that the support member is interposed between and substantially planar to the seat and the backrest upon movement of the chair from an upright position to a supine position. The support member is interposed between the seat and backrest by engagement with the connector.

In part, the present invention is an extendable chair, including (1) a seat, backrest and support member interposable between the seat and backrest, such that the seat, backrest and support member are movable between upright and supine positions; (2) a stationary frame having an interior cross dimension; (3) a movable frame having an exterior cross dimension less than that of the stationary frame; (4) a connector juxtaposed between and slidably engaging the stationary and movable frames and extendable from the stationary frame, and non-coplanar with the stationary and movable frames; and (5) an attachment member pivotably coupling the connector and the backrest, such that upon extending the connector the backrest is supinely positionable within the stationary frame.

In preferred embodiments, the connector engages both the stationary and movable frames with pairs of complementary track members. One pair of track members slidably engages the stationary frame, and the other pair of track members slidably engages the movable frame. The stationary frame includes a pair of spaced sidewalls. The seat is mounted to the movable frame, such that the seat and movable frame together have a unit dimension less than the interior cross dimension of the stationary frame.

In highly preferred embodiments, the support member is pivotably attached to the movable frame such that the support member is interposed between and substantially planar to the seat and back rest upon movement of the chair from an upright position to a supine position. The support member is interposed between the seat and back rest by engagement with the connectors. Likewise, in highly preferred embodiments, the attachment member further includes one or more pin locking assemblies to positionally secure the chair in either an upright position or a supine position.

In part, the present invention is an extendable chair, including (1) a seat member and a back rest member, said members movable from an upright sitting position; (2) a stationary frame having an interior cross dimension; (3) a movable frame having an exterior cross dimension less than said stationary frame interior cross dimension; and (4) a connector for said stationary and movable frames, the connector having a plurality of non-coplanar extensible members, wherein one of the extensible members slidably engages the stationary frame and the other extensible member slidably engages the movable frame, such that the movable frame is positioned between the stationary frame and the connector when the chair is upright. In preferred embodiments, the extensible members include a pair of two interengaging linear members, with one linear member of each of the pairs slidably engaging the other linear member. Likewise, one interengaging linear member of each pair slidably engages the stationary frame, and one interengaging linear member of each pair slidably engages the movable frame. In highly preferred embodiments, the stationary member includes a pair of spaced sidewalls, and the seat member is mounted to the movable frame, whereby each of the seat member and movable frame have a unit dimension less than the interior cross dimension of the stationary frame. Likewise, the back rest member is pivotally attached to the connector such that the back rest member is substantially co-planar with the seat member upon movement of the chair from an upright to a horizontal position. The back rest member is positioned co-planar with the seat member by locking engagement with the connector.

In part, the present invention is an extendable chair, including (1) a seat and a back rest member movable between sitting and substantially horizontal positions; (2) a stationary frame having an interior cross dimension; (3) a movable frame having an exterior cross dimension less than the stationary frame interior cross dimension; (4) a connector slidably engaging the stationary and movable frames and extendable from the stationary frame, the connector non-coplanar with the stationary and movable frames; and (5) an attachment member pivotally coupling the connector and the back rest member such that upon extending the connector the back rest is horizontally positionable.

In preferred embodiments, the connector engages each of the stationary and movable frames with two pairs of complementary track members. Likewise, one pair of track members slidably engages the stationary frame, and the other pair of track members slidably engages the movable frame.

In highly preferred embodiments, the stationary frame includes a pair of spaced sidewalls, and the seat is mounted to the movable frame, such that both the seat and movable frames have a unit dimension less than the interior cross dimension of the stationary frame. Likewise, the attachment member further includes a locking assembly to positionally secure the back rest.

As referenced above, the mechanism of this invention allows configuration of a chair article which overcomes the functional and structural limitations of the reclining chairs of the prior art, including those described above. Foremost among the available benefits is facile conversion of an upright chair with an angled seat portion to a supine rest surface comprising a seat co-planar with a backrest portion. A third cushion support is positioned and compartmentalized away from ordinary view when the chair is upright. Operation of the extensible mechanism interposes the support between and co-planar with the seat and backrest portions. Mechanism retraction returns the chair to an upright position, again without the need for rearrangement and/or replacement of cushion supports.

Mechanism movement simultaneously positions the backrest forward from its original upright position, thereby imparting to the chair article a distinctive wall-proximate quality. In contrast hereto, wall-proximate chairs of the prior art are designed and configured such that maintaining backrest placement relative to a wall or confining support is accomplished only through divergence of other chair components away from a planar arrangement. The chair and the mechanism of the present invention are designed such that extension is initiated in a planar fashion and the components of the supine rest surface are thereafter orientated in conformity therewith.

The substantially-planar horizontal supine surface so obtained is preferable for long periods of restful sleep in surroundings which, for reasons of decorum and area constraint, do not permit placement of cots, twin beds, or the like. As such, the chair articles of the present invention are ideally suited for use in a health care setting or environment. Through use of the present invention, inpatient care is now available with accommodations for friends, spouses, or relatives who wish to remain close without incurring additional lodging expenses. Likewise, overnight stays in a patient's room need no longer be accompanied by interrupted sleep or back and related body aches.

The mechanism of the present invention also allows the chair article to be extended or retracted without undue hazard to unwary users. As described herein and evident from the following figures, the extensible components are configured to minimize direct exposure to hands or fingers during operation. While all due care and caution must be observed when operating the mechanism and chair articles of this invention, vertical alignment of complimentary track members, in conjunction with protective side plates, as utilized in preferred embodiments, may prove beneficial by reducing the incident of injury.

BRIEF DESCRIPTION OF THE DRAWINGS

The invention, together with the further objects and advantages thereof, may be best understood by reference to the following descriptions taken in conjunction with the accompanying drawings, wherein the reference numerals identify like elements, and wherein.

DETAILED DESCRIPTIONS OF PREFERRED EMBODIMENTS

The drawings illustrate an improved extendable chair article 10 which is a preferred embodiment of this invention. The article includes a unique extensible mechanism, which allows for conversion of chair 10 to a supine resting surface.

Figure 1:
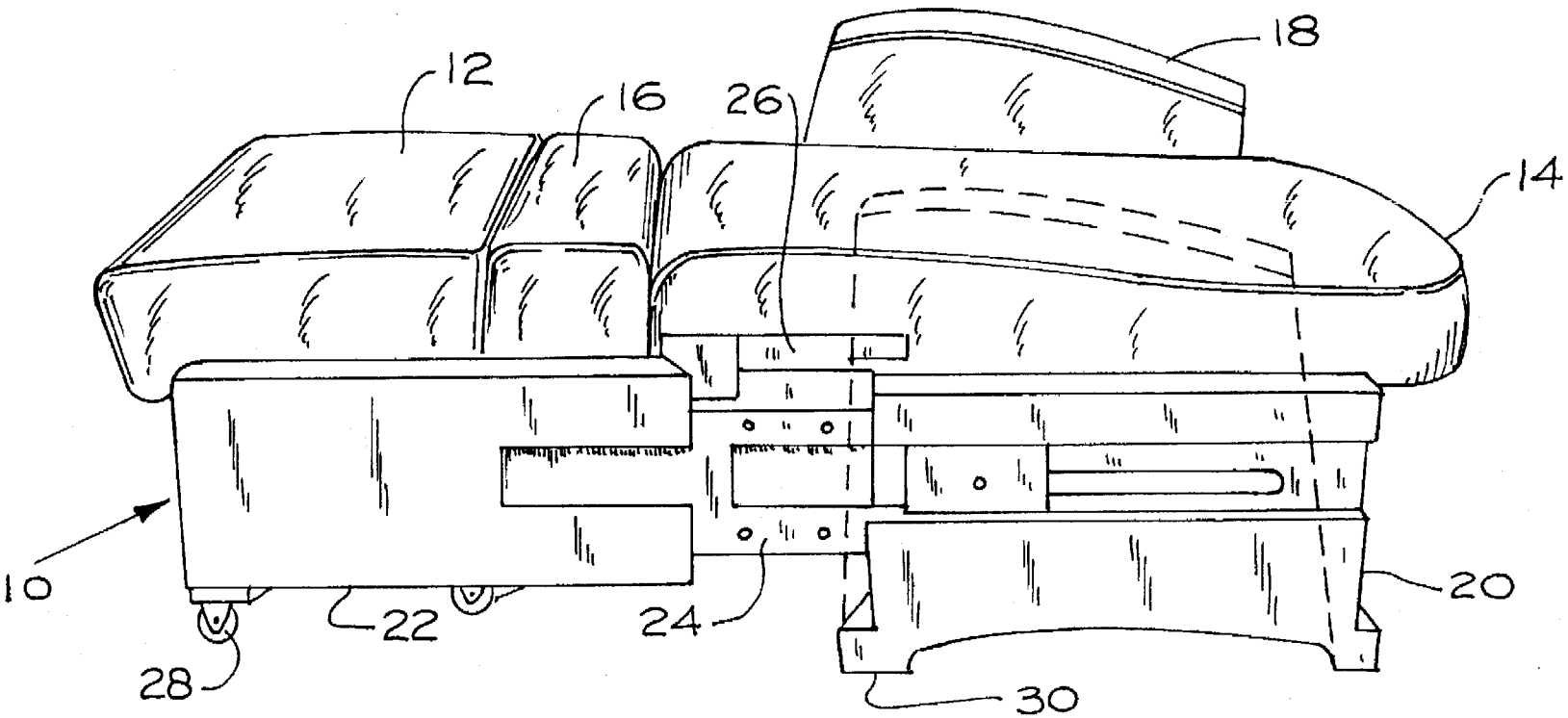
FIG. 1 is a perspective view of an extendable chair, in accordance with the present invention, positioned to provide a supine rest surface.

As shown in FIG. 1, seat portion 12, back rest 14, and interposable support members 16 can be arranged and configured to provide a substantially horizontal, planar surface. Connector 24 couples stationary frame 20 with movable frame 22 and separates the latter when extended. As shown in FIG. 1, back rest 14 is secured to connector 24 with attachment members 26. Arm rest 18 in part defines the peripheral edge of the supine surface. Wheels/casters 28 provide one of several means for facilitating movement of movable frame 22 and connector 24 with respect to stationary frame 20. Foot members 30 elevate stationary frame 20 in either the sitting or supine position.

Figure 2:
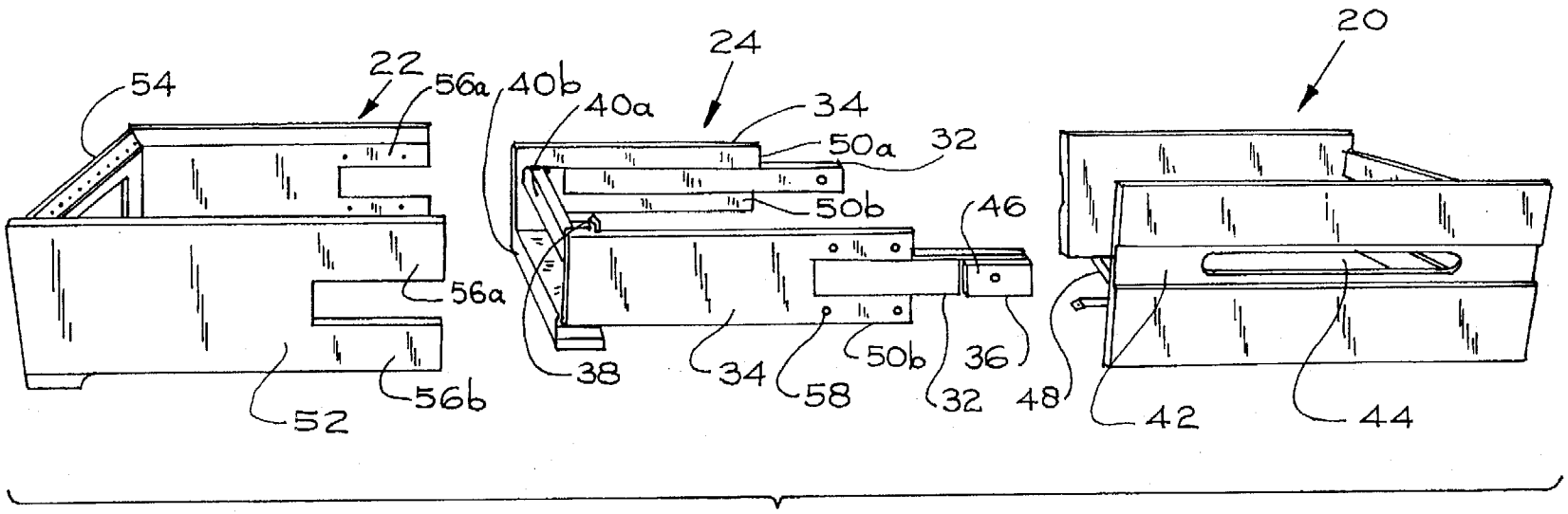
FIG. 2 is an exploded view of a preferred extendable mechanism, in accordance with the present invention.

As best shown in FIG. 2, connector 24 includes first and second extensible linear members 32 and 34, respectively. It should be understood that while each of extensible members 32 and 34 of connector 24 can be referred to individually in the singular with equal effect, each includes a pair of two interengaging linear members, as shown in FIG. 2. Linear member 32 can further include engagement member 36 to position extensible member 32 apart from stationary frame 20. Area 42 of stationary frame 20 is configured with aperture 44 to receive extensible member 32. Coupled with engagement member 36 through aperture 44, cap 46 facilitates sliding engagement of linear member 32 with stationary frame 20. Second extensible members 34 are linked by cross supports 40*a* and 40*b*, and comprise vertically-aligned receptive members 50*a* and 50*b* for slidable engagement with first extensible member 32. Movable frame 22 comprises vertically-aligned members 56*a* and 56*b* and associated sidewalls 52 for slidable engagement with extensible member 34 of connector 24, the extent of which is limited by stop member 38. The structural integrity of movable frame 22 can be enhanced through incorporation of support members 54. Fastener means 58 are usable in conjunction with extensible member 34 for engagement of the back rest pivot assembly, as shown more clearly in FIG. 7, below.

As described above and shown more clearly in FIG. 3A, the mechanism of the present invention, irrespective of its use with or outside the context of an extendable chair article, comprises a plurality of extensible members 32 and 34 of connector 24 slidably engaging one another, as well as movable frame 22, by way of pairs of complementary track and rail members. Vertically aligned members 56*a* and 56*b* have incorporated therewith corresponding track members 60*a* and 60*b*, which are configured and arranged to receive rail members 62*a* and 62*b*, respectively, of extensible linear member 34. In a similar fashion, extensible linear member 32 includes track members 64*a* and 64*b* for slidable engagement with complementary rail members 62*c* and 62*d* (the latter of which is not observable in the perspective view of FIG. 3A) of extensible linear members 34.

The slidable engagement of connector 24 and the extensible members thereof with either movable frame 22 or stationary frame 20 can be accomplished through use of alternate embodiments. In one such preferred embodiment, as shown in FIG. 3B with respect to the engagement of connector 24 and movable frame 22, the rail members can be configured so as to limit interaction with complementary track members along two surfaces, thereby reducing friction upon slidable engagement, one with the other.

Figure 3A:
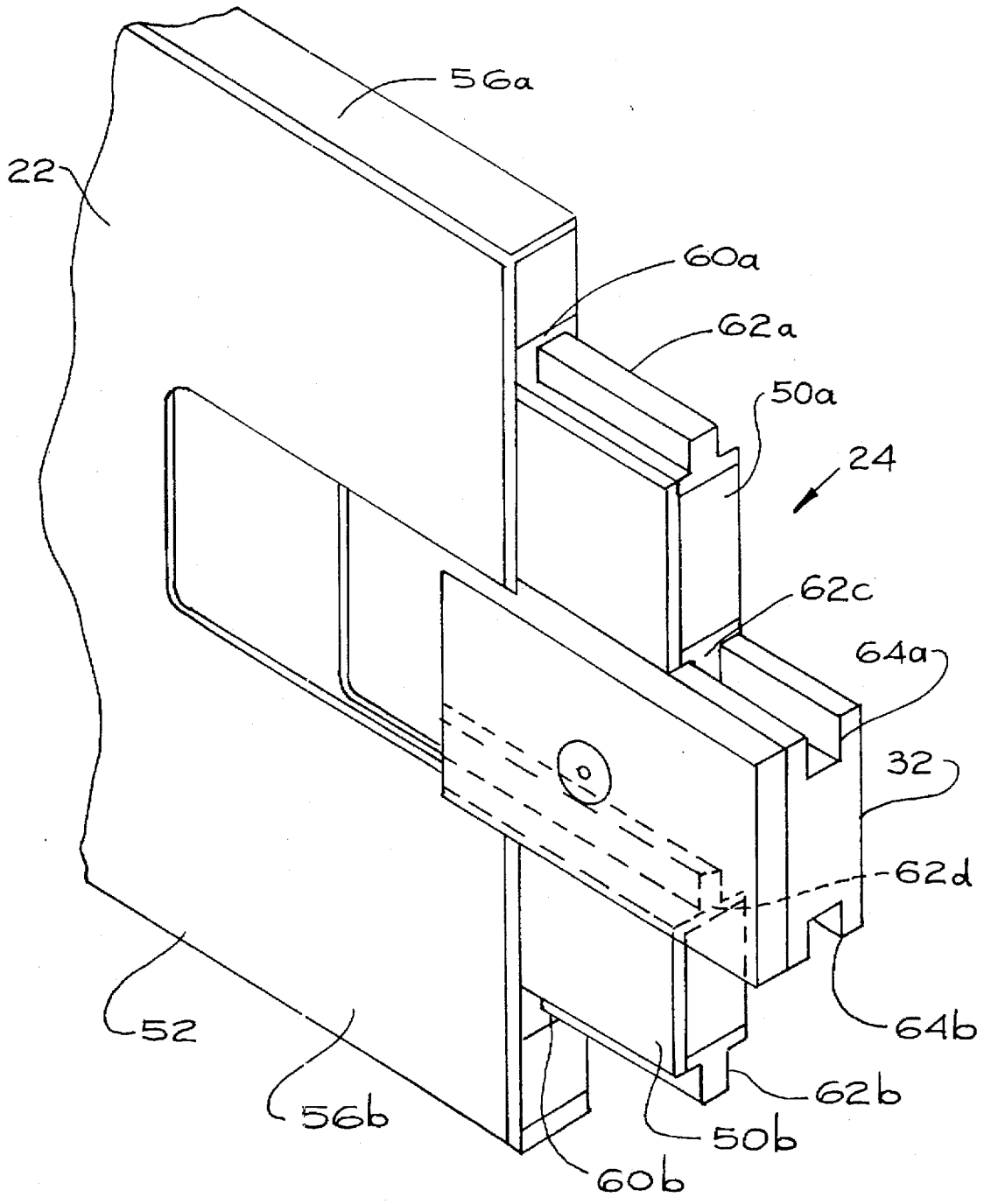
FIG. 3A is a partial end view of a connector/movable frame combination, in accordance with the present invention.
Figure 3B:
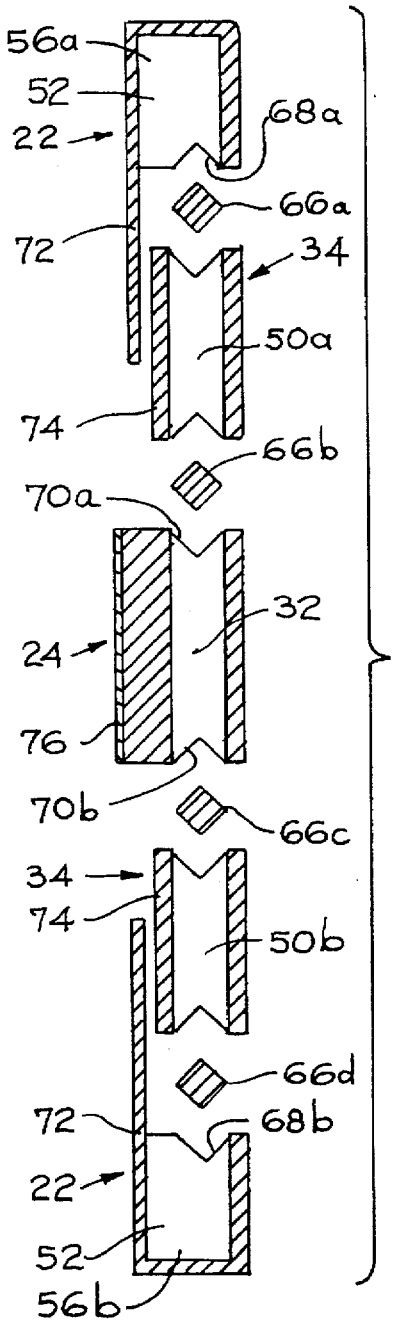
FIG. 3B is an exploded end view of a preferred connector/movable frame combination, in accordance with the present invention.

In a manner similar with the structure shown in FIG. 3A, FIG. 3B shows, from an end view perspective, one pair of first and second extensible linear members, 32 and 34, respectively, of connector 24 in slidable engagement with vertically aligned members 56*a* and 56*b* of movable frame 22. Again, in this particular embodiment, sidewalls 52 assist alignment of the extensible members and promote slidable engagement, while providing protection against accidental injury involving the relative movement of movable frame 22 and connector 24. Rails 66*a–d* are positioned intermediary to vertically aligned members 50*a* and 50*b*, and first and second extensible linear members 32 and 34, respectively. In one embodiment of the present invention, rails 66*a–d* are positioned between the corresponding movable frame and connector members, such that lateral movement is prohibited by the configuration of the corresponding track members above and below rails 66*a–d*. Movable frame 22 and connector 24 are preferably adapted to prohibit linear movement of rails 66*a–d*. In highly preferred embodiments, rails 66*a–d* are secured in one of the two vertically aligned track members. In one such embodiment, rails 66*a*–66*d* are secured to second extensible linear members 34. Rails 66*a* and 66*b* slidably engage vertically aligned member 56*a* and first extensible linear member 32, respectively, through engagement with track members 68*a* and 70*a*, respectively. In a similar fashion, rails 66*c* and 66*d* slidably engage first extensible linear member 32 and vertically aligned member 56*b*, respectively, through engagement with track members 70*b* and 68*b* respectively. Likewise, in preferred embodiments, for the purpose of reducing friction, movable member 22 and the first and second extensible linear members of connector 24 can be provided with surface members 72, 74, and 76, constructed of a self-lubricating resin material, as described below.

Figure 4:
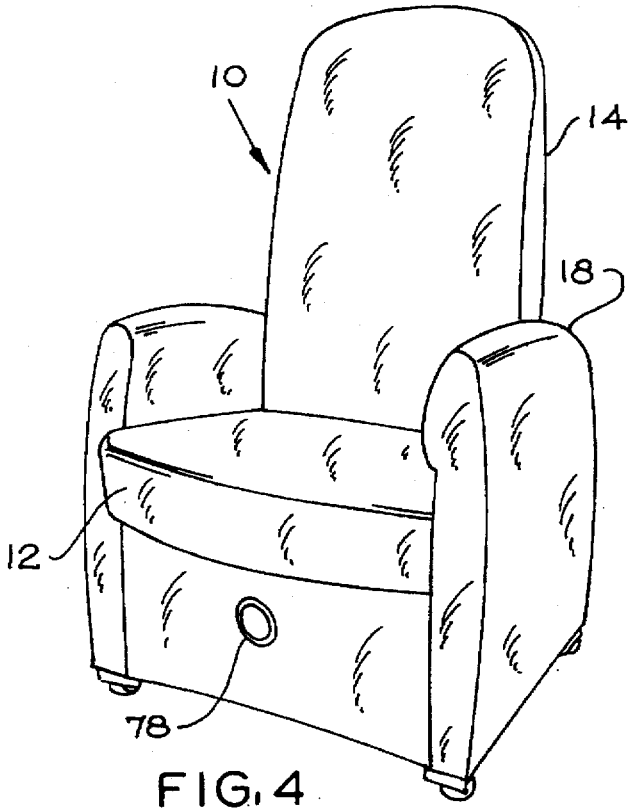
FIG. 4 is an elevated perspective view of an extendable chair, in accordance with the present invention, positioned to provide a sitting surface.

FIG. 4 shows an extendable supine chair 10 of the present invention in an upright position. Backrest 14 is posterior to seat portion 12, which is positioned superior to movable frame 22 and between armrests 18. Release/accuator 78 of movable frame 22 operates the mechanism shown in FIG. 5. Cable 80 enclosed within sheath 82 is controlled by release 78 to manipulate pin 84 relative to bracket 86. Spring 88 operates to maintain the engagement of pin 84 and chair 10 in an upright position. Movement of the chair 10 to a supine position is initiated through operation of release 78 and retraction of pin 84 with respect to bracket 86. Retraction of pin 84 and/or initiation of mechanism and chair extension can also be accomplished through use of a number of other assemblies, including but not limited to a handle or similar such grasping device which disengages pin 84 or a functionally-related apparatus from another corresponding component of the mechanism and/or chair with a simple forward and/or upward motion of the movable frame.

Figure 6:
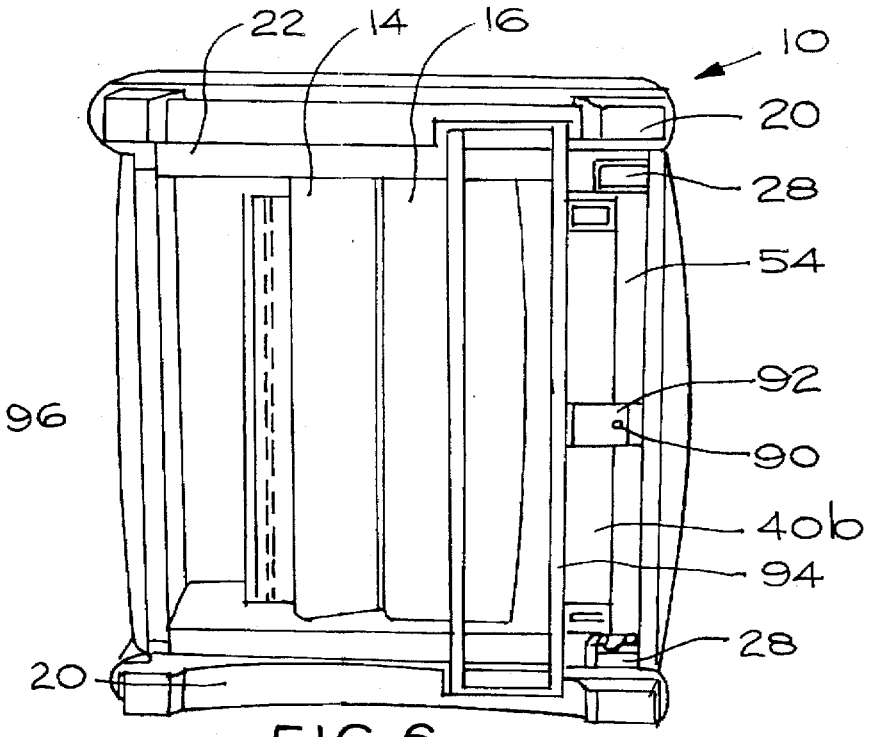
FIG. 6 is a bottom view of the extendable chair of FIG. 4.

A bottom view of a preferred extendable chair 10, of the present invention, is shown in FIG. 6. As described above, pin 84 of movable frame 22 is shown positioned within hole 90 of tongue 92 mounted to stationary frame 20 by way of cross supports 94. As best shown in FIG. 6, interposable support member 16 is anterior and adjacent to backrest 14 when the extendable chair is in an upright position. With reference to FIG. 4 interposable support member 16 is directly below and hidden from normal, ordinary view by seat portion 12. Also shown in FIG. 6, and attached to backrest 14, is backrest edge 96, the function of which is explained in detail, below. Upon release of pin 84 from tongue 92, movable frame 22 and connector 24 can be extendably positioned distal to stationary frame 20. In highly preferred embodiments, movable frame 22 and connector 24 are extended and positioned with the aid of wheels/coasters 28 mounted to cross supports 54 and 40, respectively.

Figure 7:
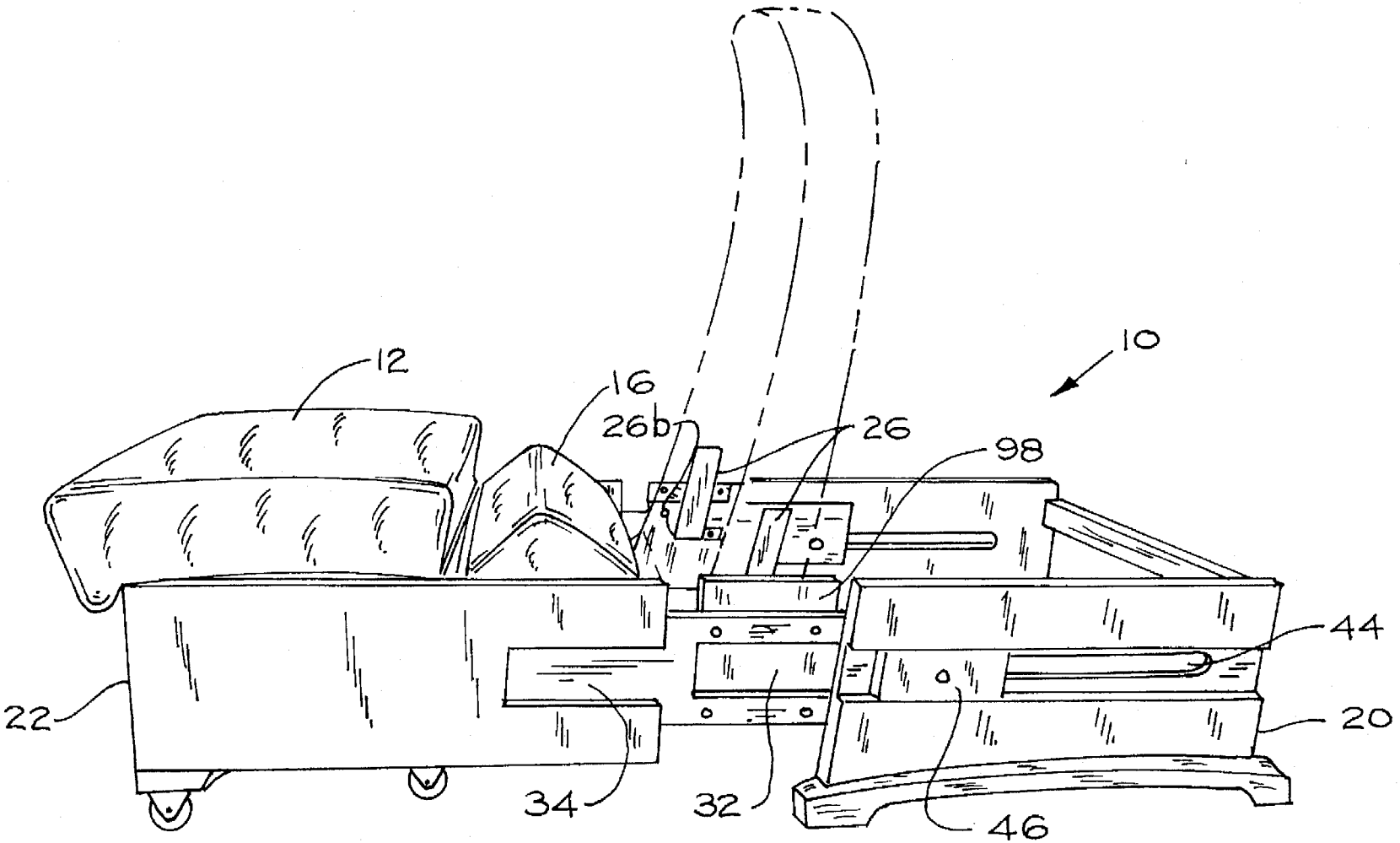
FIG. 7 is a partial elevated perspective view of an extendable chair, in accordance with the present invention, positioned to provide partial extension.

Extension of movable frame 22 and connector 24, is concurrent with interposition of support member 16. As shown in FIG. 7, partial extension of frame 22 and connector 24 brings member 16 to an intermediate position. With reference to the position of cap 46 relative to aperture 44 of stationary frame 20, it is seen that the first and second extensible linear members are nearly completely extended. Additional extension of movable frame member 22 will supinely position interposable support member 16 adjacent to seat portion 12. FIG. 7 also shows attachment members 26 coupled to second extensible linear member 34 by way of mounts 98. The attachment members, secured to and supportive of backrest 14 (not shown in FIG. 7), are positioned to maintain backrest 14 in an angled relationship to seat portion 12 and support member 16 when chair 10 is in an upright position.

Figure 8:
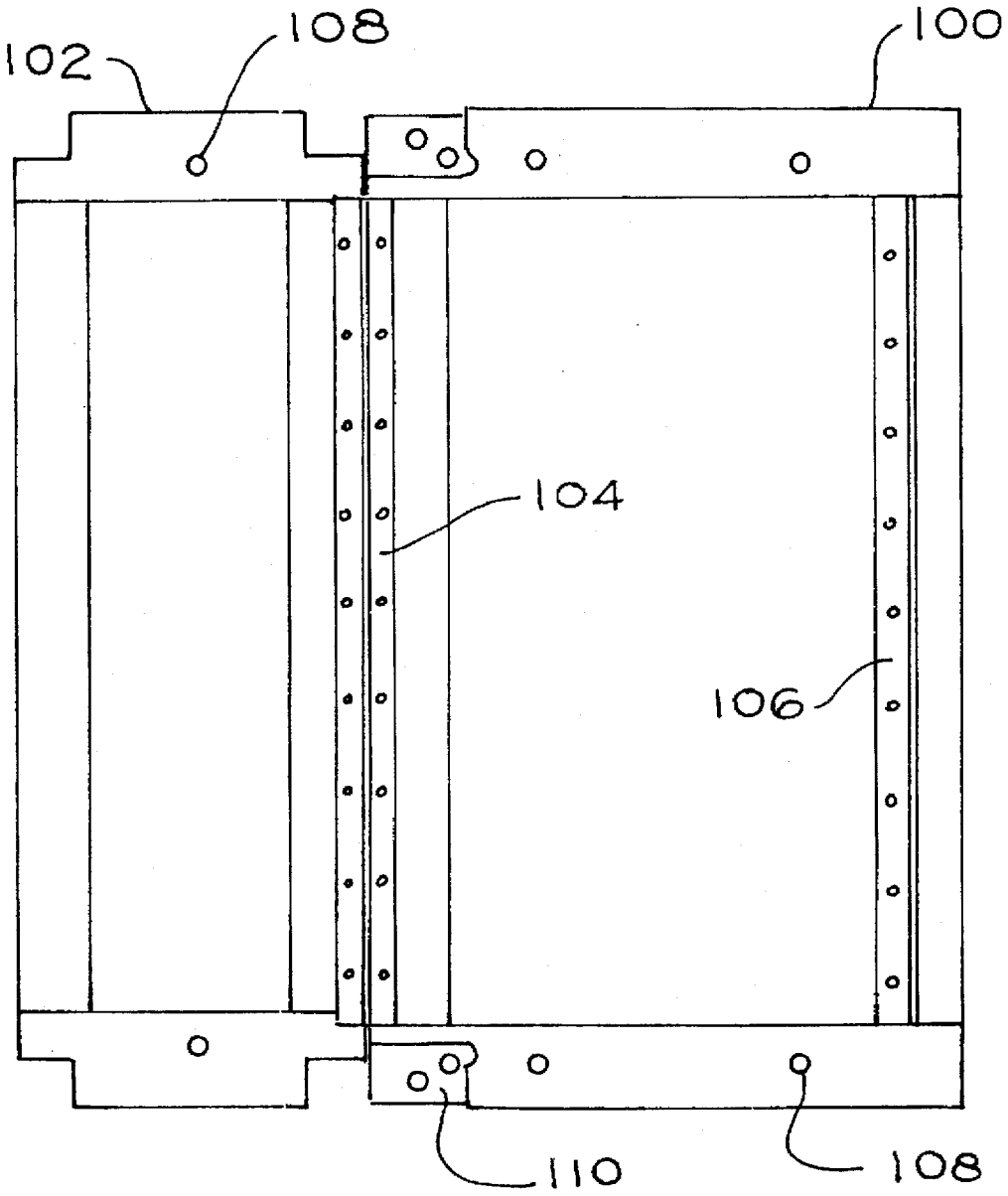
FIG. 8 is top view of a frame assembly of a preferred extendable chair, which can be used to couple a seat portion and an interposable support to a movable frame and connector, respectively.

In preferred embodiments, seat portion 12 and interposable support members 16 are secured to movable frame 22 and connector 24, respectively. As shown in FIG. 8, this can be accomplished by the combination of mounting member 100 (to secure seat portion 12) and mounting member 102 (to secure interposable support member 16). Mounting members 100 and 102 are coupled by pivotable linkage 104, which permits interposable support member 16 to be positioned below seat portion 12 when an accompanying chair is upright. (See FIGS. 4 and 6.) Pivotable linkage 106 coupled to the anterior of seat portion 12 allows the latter to be sloped downward and toward backrest 14 when the chair of this invention is in an upright position. Attachment means 108 secure both seat portion 12 and interposable support members 16 to their respective mounting members. Attachment means 110 secure the mounting members to movable frame 22.

Figure 9:
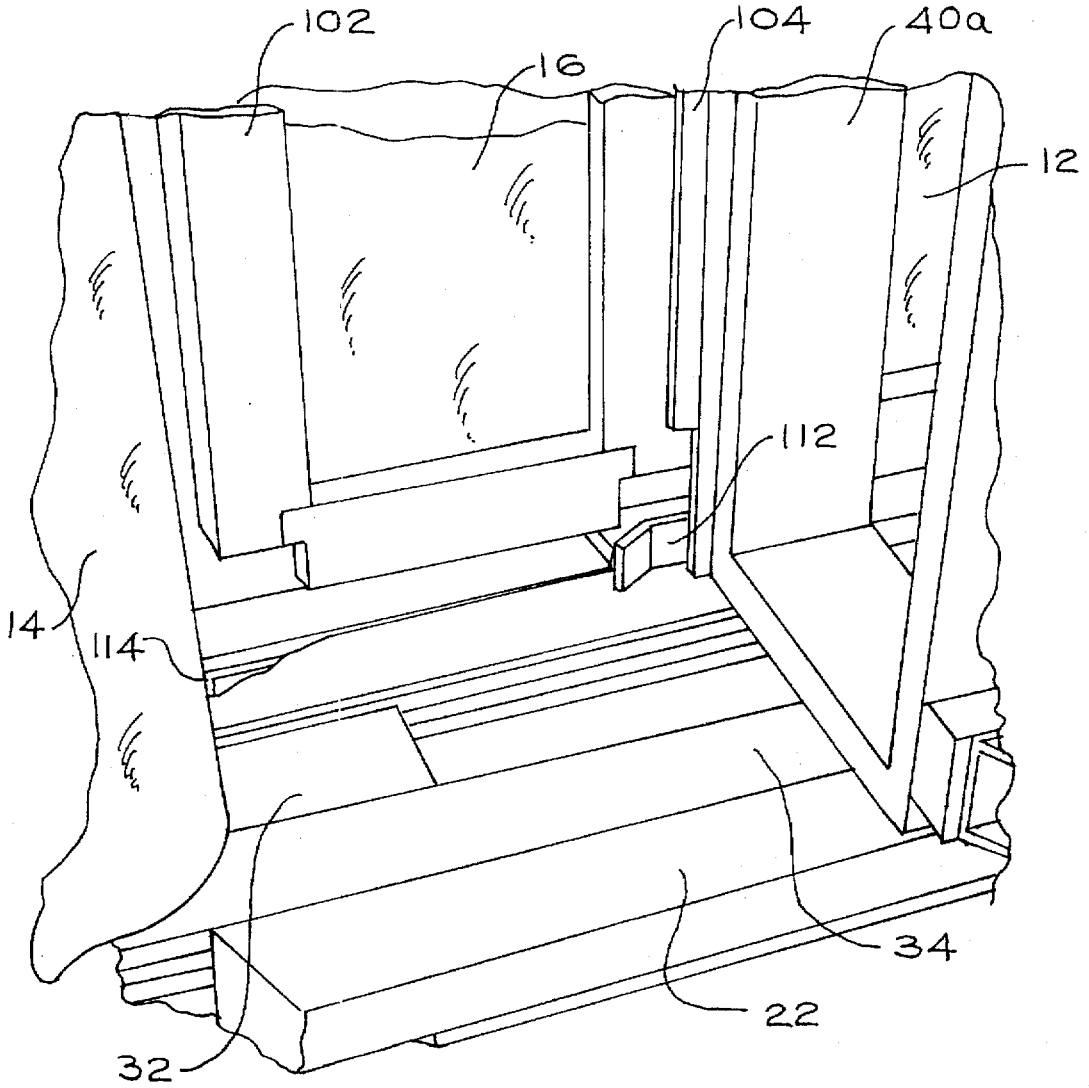
FIG. 9 is a partial bottom view of the interaction of a connector, movable frame, and interposable support member, in accordance with the present invention.

With reference to FIGS. 7 and 8, complete extension of movable frame 22 supinely positions interposable support member 16. As partially shown in FIG. 9, continued extension of movable frame 22 and seat portion 12 bring interposable support member 16 and mounting member 102 in contact with connector cross support 40 and positioning tab 112. Continued movement of mounting frame 102 along and with respect to positioning tab 112 extends pivotable linkage 104 and levels interposable support member 16, bringing the latter into co-planar alignment with seat portion 12. Also shown in FIG. 9 in conjunction with first extensible linear member 32 and second extensible member 34 is incline track 114 which either levels or provides a downward slope to the posterior of seat portion 12, depending on whether chair 10 is in an upright or supine position.

Figure 10A:
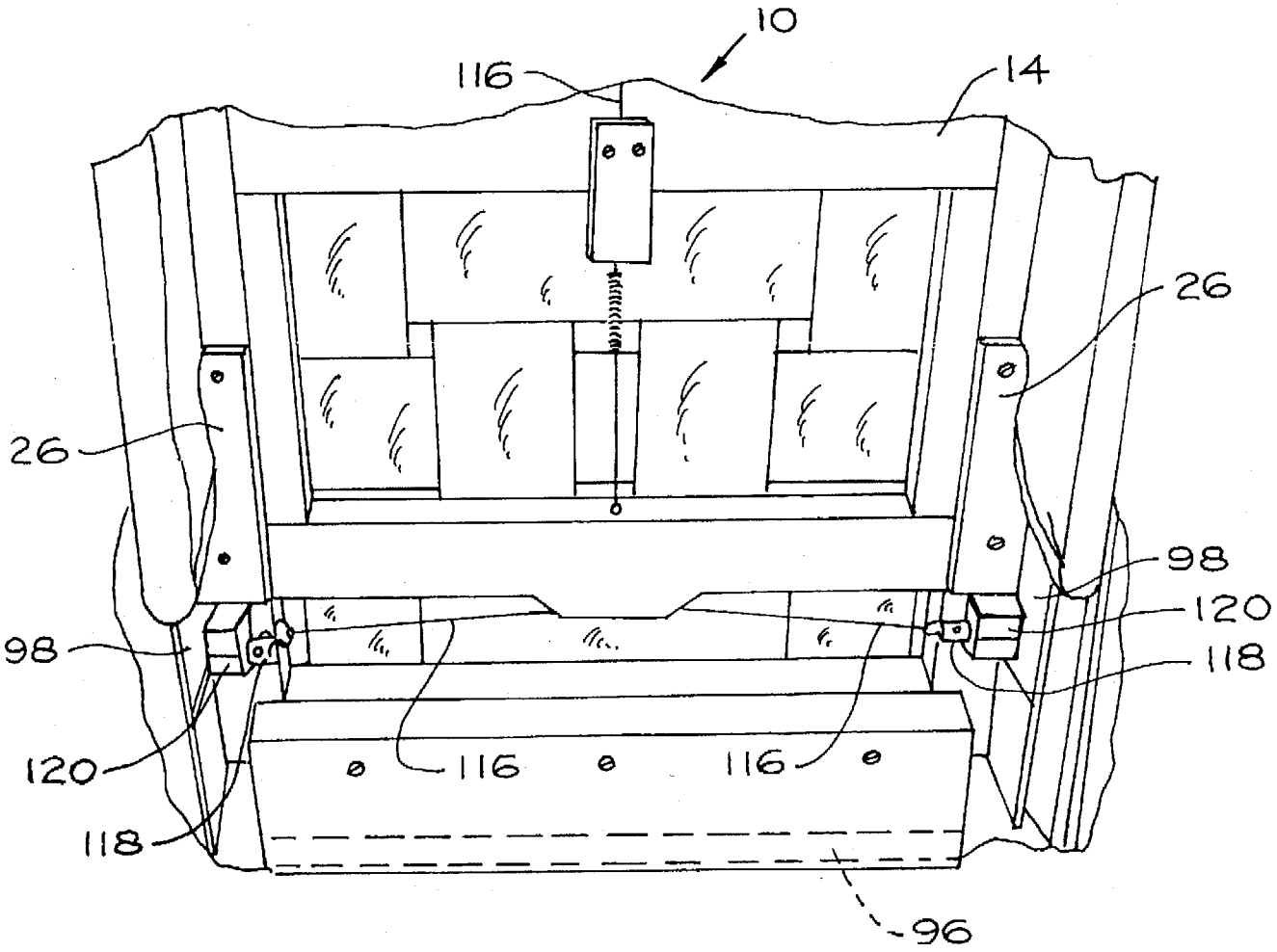
FIG. 10A is a partial perspective view of an interacting backrest, attachment members, and mounts of a preferred extendable chair positioned in a sitting position, in accordance with the present invention.
Figure 10B:
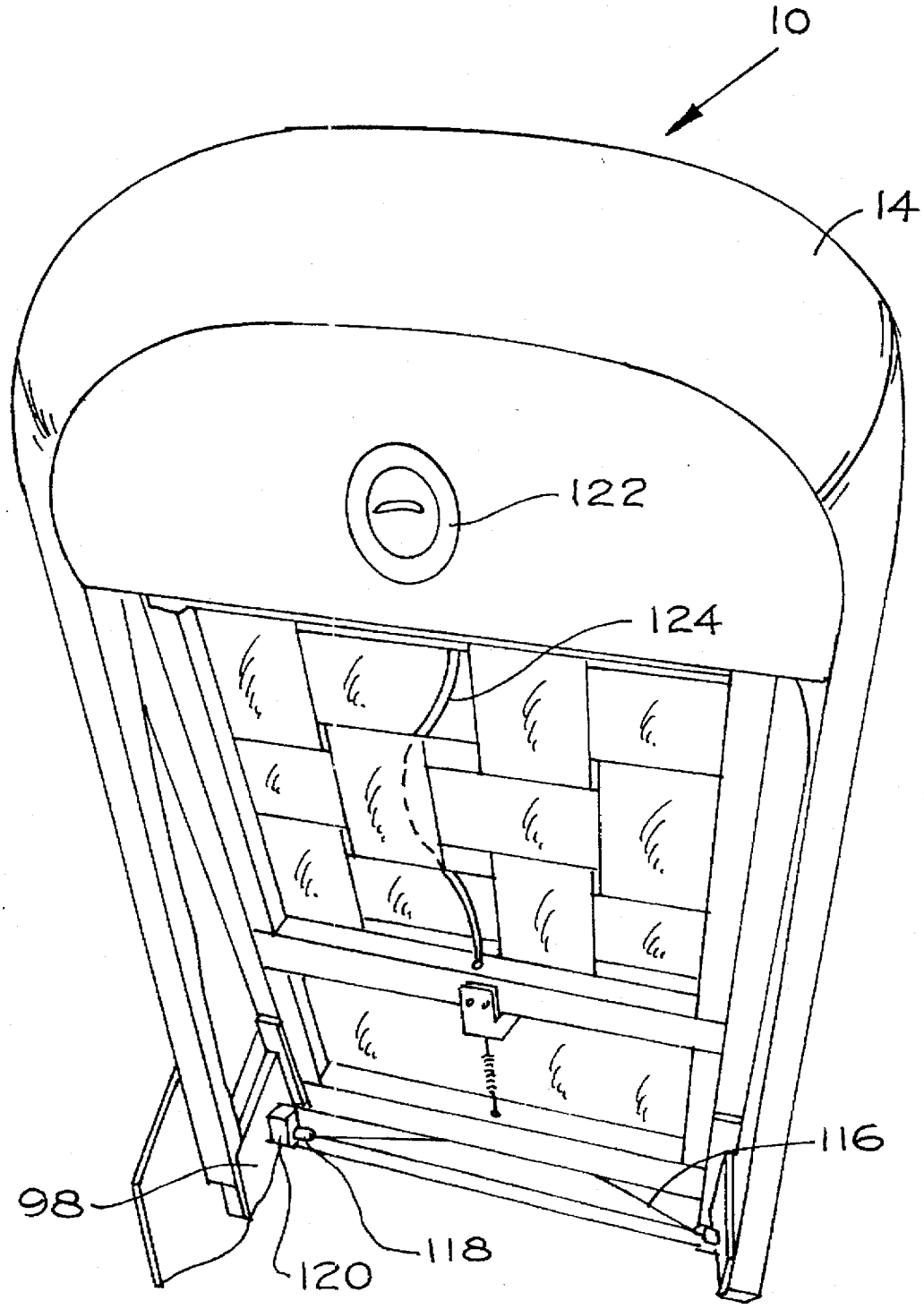
FIG. 10B is an elevated perspective view of a backrest and accuator assembly, in accordance with the present invention.

As shown in FIG. 10A, backrest 14 is secured to attachment members 26, which are further coupled to mounts 98, respectively. Cable 116 is configured and arranged to manipulate pins 118 in a synchronized fashion with respect to their respective anchors 120. Backrest edge 96 extends below backrest 14 and mount 98. A full perspective view of a backrest assembly in accordance with the chair of this invention is shown in FIG. 10B. Release/accuator 122 contracts cable 116 within sheath 124 to manipulate pins 118 with respect to anchors 120 and mounts 98. In a similar manner, cable 116 can be utilized in conjunction with a pivoting mechanism commonly referred to as a bell crank or the functional equivalent thereof to removably engage rods extending perpendicular therefrom with respect to anchors 120 and/or mounts 98 associated with connector 24.

Figure 11:
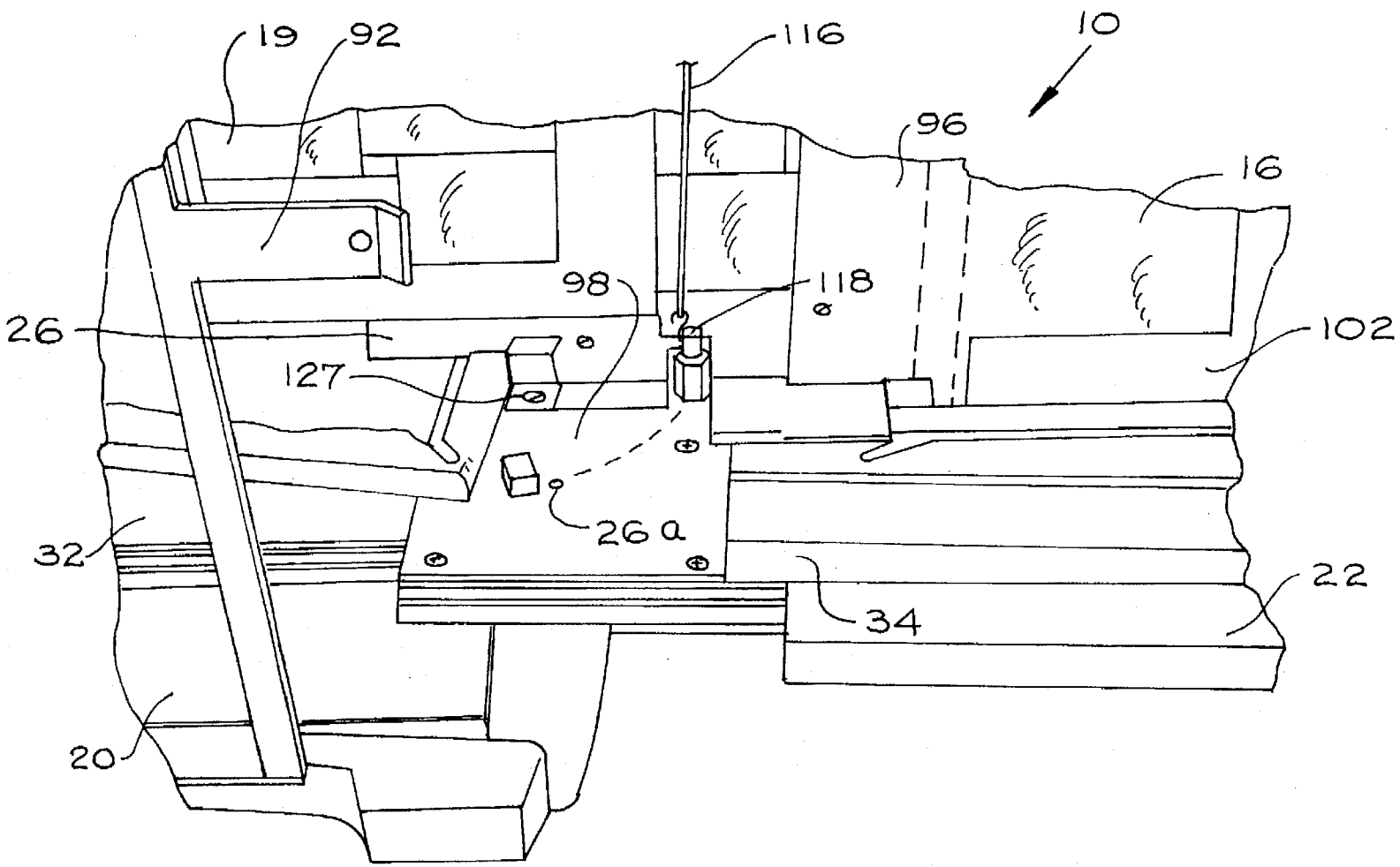
FIG. 11 is a partial bottom view of an interacting backrest, attachment member, mount, and connector of a preferred extendable chair positioned to provide a supine rest surface, in accordance with the present invention.
Figure 13:
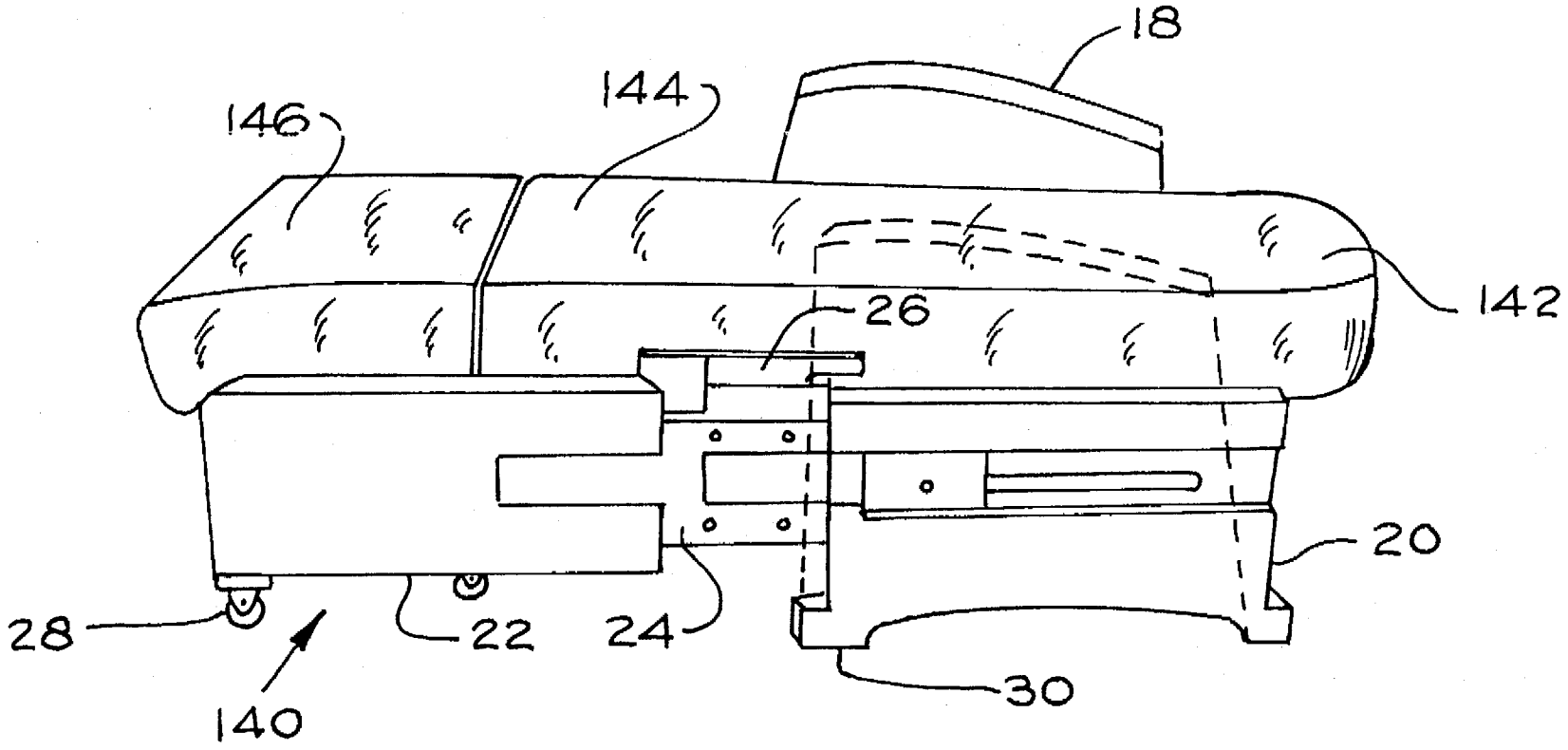
FIG. 13 is a perspective view of an extendable chair, in accordance with the present invention, positioned to provide a substantially supine and/or horizontal rest surface.
Figure 14:
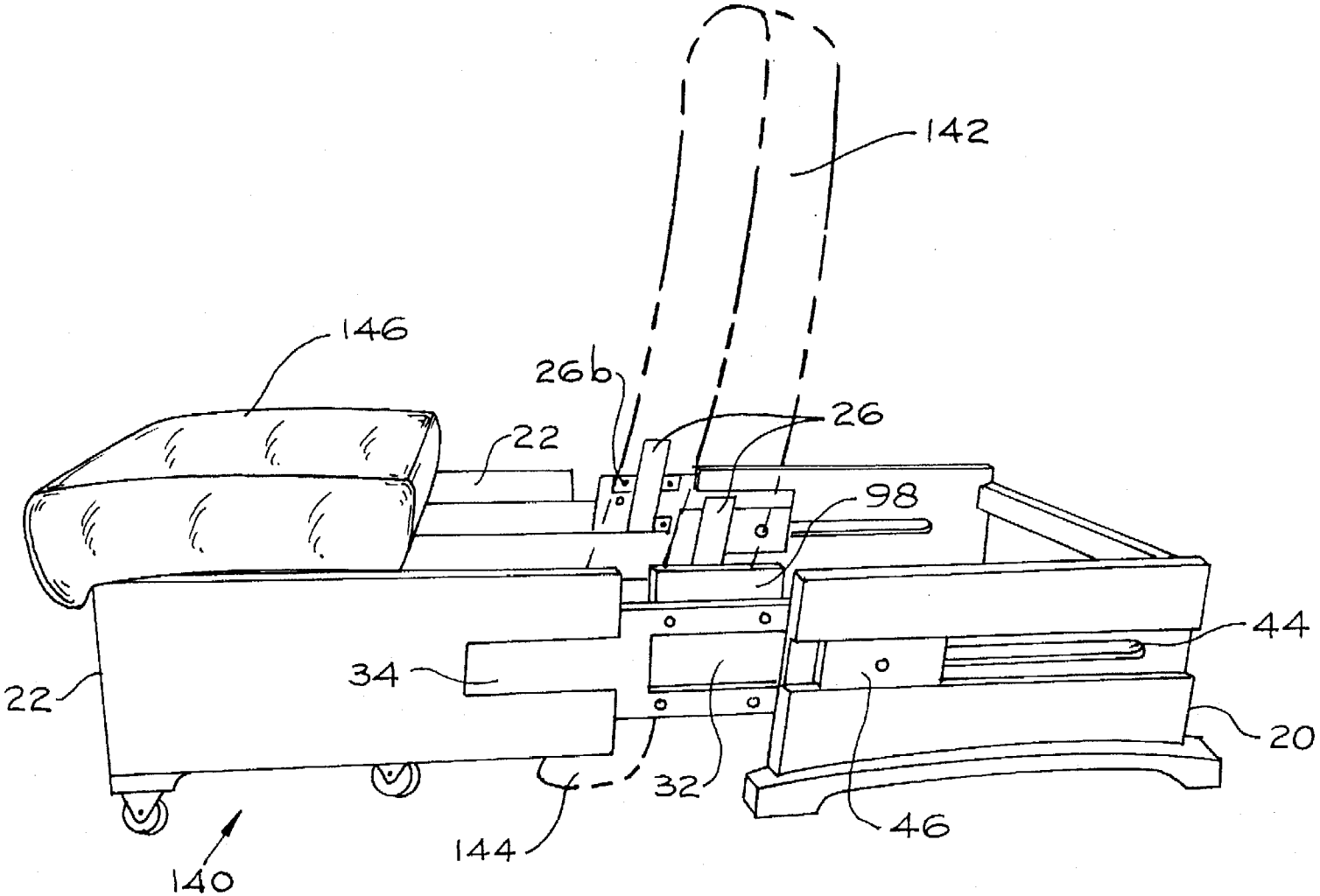
FIG. 14 is a partial elevated perspective view of an extendable chair, in accordance with the present invention, positioned with an extensible mechanism partially extended and showing back rest attachment members unaligned with respect to a horizontal rest surface.
Figure 15:
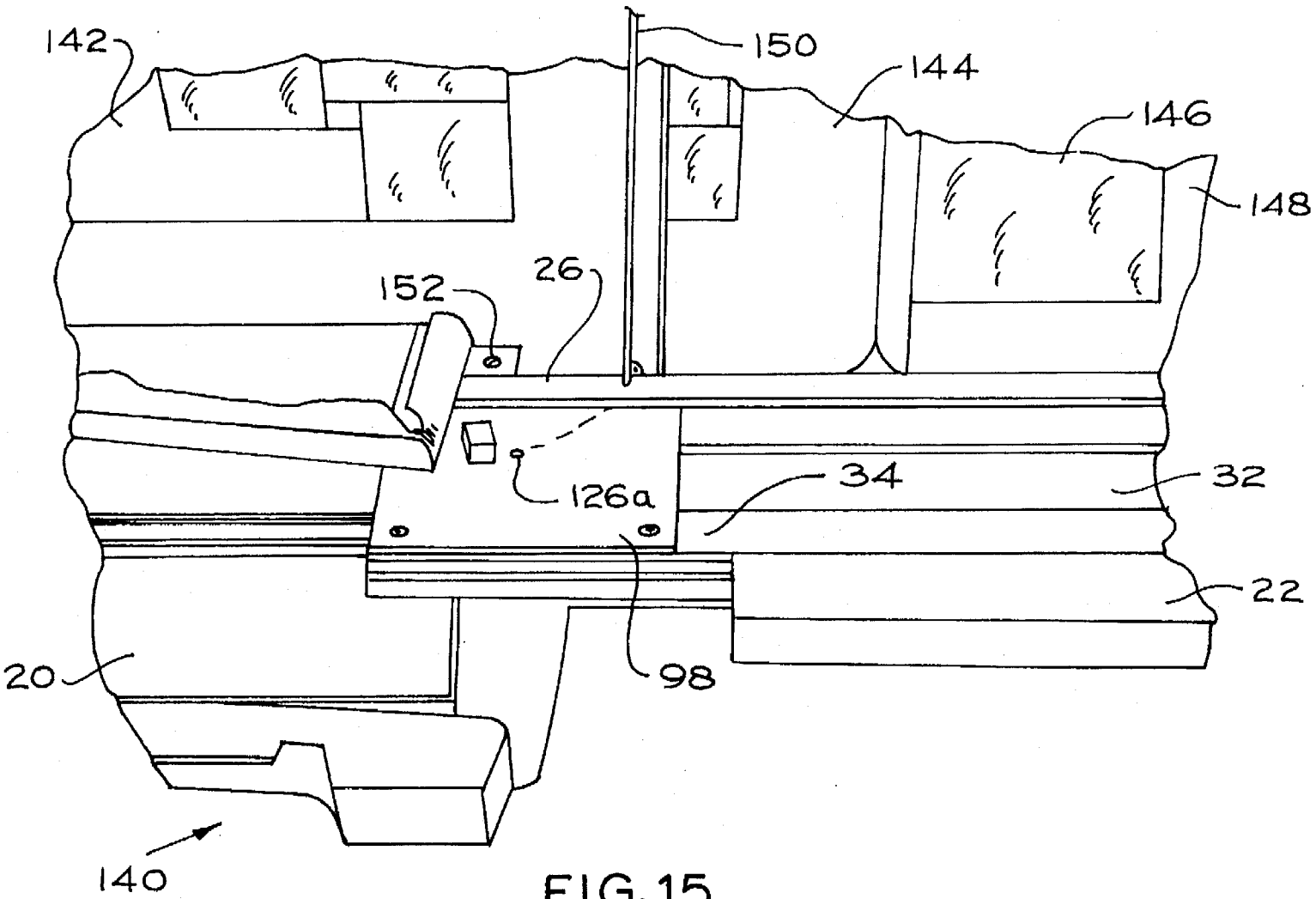
FIG. 15 is a partial bottom view of a back rest member pivoted and interacting with a seat member and connector of a preferred extensible mechanism to provide a supine and/or substantially horizontal rest surface, in accordance with the present invention.

As shown in FIG. 11, backrest 14 is released and pivoted such that attachment members 26 are parallel to extensible linear members 32 and 34. Backrest 14 and attachment members 26 are pivoted by moving pins 118 from placement guides 26*a* in mounts 98, rotating the backrest and attachment members about pivot members 127 and engaging pins 118 with placement guide 26*b*. (See, also, FIG. 7.) It should be understood that while each attachment member 26, pin 118 and placement guide 26*a–b* can be referred to individually in the singular with equal effect, each is part of a pair in preferred embodiments such as that shown in FIG. 11. Likewise, attachment member 26 and connector 24 can be utilized in conjunction with back rest 142 (as shown in FIGS. 13 and 15) through coordinated use of engagement rods and a pivoting mechanism as described above. Rotation about pivot member 127 also brings backrest edge 96 into parallel alignment with the extensible members of connector 24 and in supportive engagement with mounting member 102, thereby maintaining interposable support member 16 co-planar with backrest 14 and seat portion 12, as shown in FIG. 1. Refer also to FIGS. 13–15 with respect to the rotation/pivot of backrest member 142 to a substantially horizontal position and in co-planar alignment with seat 146. The present invention also contemplates alignment of interposable portion 144 with an interposable support member such as member 16 or the functional equivalent thereof to provide an elongated rest surface. With further reference to FIG. 11, mount 98 is preferably aligned with and coupled to the extensible members of connector 24 so as not to impede slidable engagement, one with the other, or with stationary frame 20 and movable frame 22.

Figure 12A:
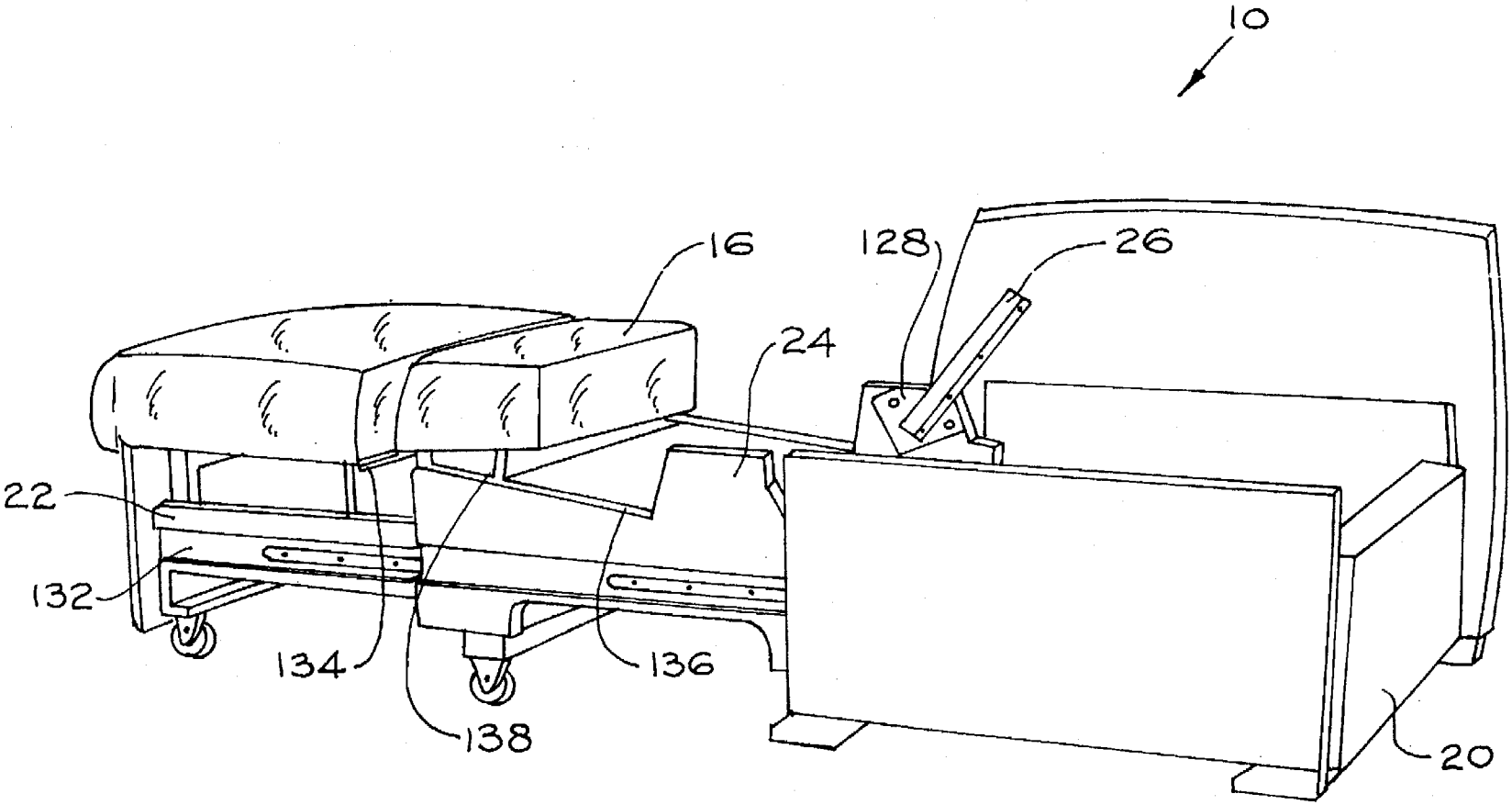
FIGS. 12A and 12B are partial elevated perspective views of an extendable supine chair, in accordance with the present invention.
Figure 12B:
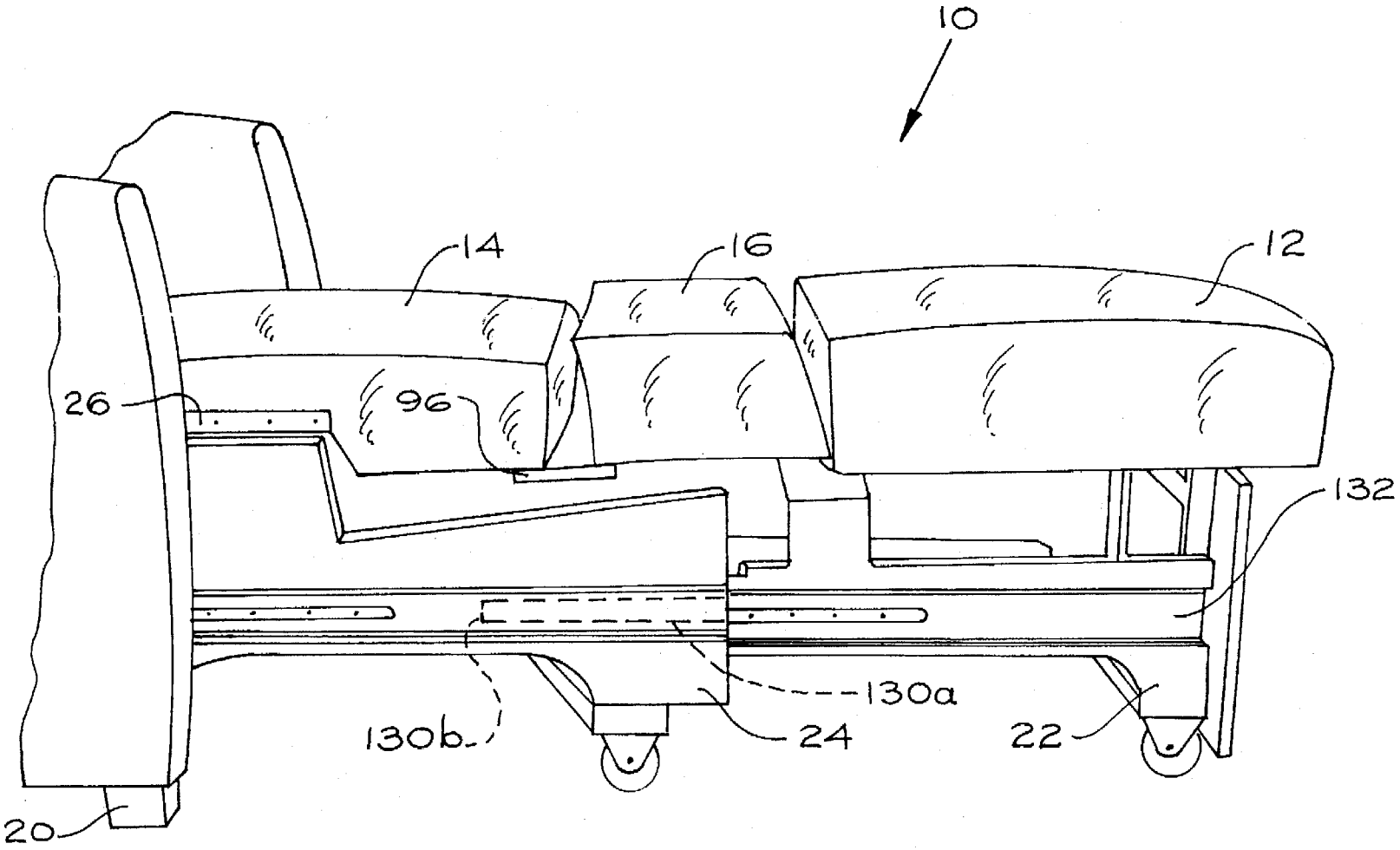

Alternate embodiments of the present invention are shown in FIGS. 12A and 12B. With reference more particularly to FIG. 12A, another extensible chair of the present invention includes stationary frame 20, movable frame 22, and connector 24. The seat portion 12 and interposable support member 16 are shown in co-planar alignment to provide a supine rest surface. Attachment members 26 secure and pivot the chair backrest (not shown) about mounts 128. (See, also, FIG. 12B, below.) Connector 24 is juxtaposed in slidable engagement with both stationary frame 20 and movable frame 22 by way of inside connector track members 130*a* (not shown) and outside connector track members 130*b* (one of pair shown). Movable frame 22 includes track member 132 complimentary to connector track members 130*b*. In a similar fashion, stationary frame 20 includes a pair of track members (not shown) complimentary to connector track members 130*b*.

Referring to FIG. 12B, interposable support member 16 can be coupled to seat portion 12 by way of pivot axis 134. As movable frame 22 is extended from connector 24 and stationary frame 20, seat portion 12 moves from a position supported by inclined edge 136 of connector 24 to a supine position enhanced by level support member 138. Interposable support member 16 is supported, in part, by horizontal support 138 and, in part, by backrest edge 96 (see FIG. 12A) positioned thereunder when backrest 14 is pivotally rotated to a supine position co-planar with interposable support member 16 and seat portion 12.

The drawings also illustrate an improved extendable chair article 140 which is another preferred embodiment of this invention. Article 140 also includes a unique extensible mechanism, which allows for conversion of chair 140 to a supine resting surface. As shown in FIG. 13, seat portion 146, back rest 142, and interposable portion 144 of back rest 142 can be arranged and configured to provide a substantially horizontal, planar surface. Connector 24 couples stationary frame 20 with movable frame 22 and separates the latter when extended. As also shown in FIG. 13, back rest 142 is secured to connector 24 with attachment members 26. Arm rest 18 in part defines the peripheral edge of the supine horizontal surface. Wheels/casters 28 provide one of several available assemblies for facilitating movement of movable frame 22 and connector 24 with respect to stationary frame 20, as well as movement of chair 140 whether in an upright or extended position. Foot members 30 elevate stationary frame 20 in either the sitting or supine position.

As illustrated in FIG. 14, extension of movable frame 22 and connector 24, can be concurrent with movement of backrest 142. Partial extension of frame 22 and connector 24 brings member 142 to an intermediate position. With reference to the position of cap 46 relative to aperture 44 of stationary frame 20, it is seen that the first and second extensible linear members are nearly completely extended. Additional extension of movable frame member 22 will further advance member 142. FIG. 14 also shows attachment members 26 coupled to second extensible linear member 34 by way of mounts 98. The attachment members, secured to and supportive of back rest member 142 (not shown in FIG. 14), are positioned to maintain back rest 142 in an angled relationship to seat portion 146 when chair 140 is in an upright position.

As shown in FIG. 15, back rest member 142 is released and pivoted such that attachment members 26 are substantially parallel to extensible linear members 32 and 34. Back rest member 142 and attachment members 26 are pivoted by engagement rods 150, as described above, from placement guides 126*a* in mounts 98, rotating the back rest and attachment members about pivot members 152 and rods 150 with placement guide 126*b*. (See, also, FIGS. 7 and 11.) It should be understood that while each attachment member 26, engagement rods 150 and placement guide 126 can be referred to individually in the singular with equal effect, each is part of a pair in preferred embodiments such as that shown in FIGS. 11 and 15. Rotation about pivot member 152 also brings interposable portion 144 of member 142 into parallel alignment with the extensible members of connector 24 and adjacent to mounting member 148, such that interposable portion 144 is co-planar with seat 146 as shown in FIG. 13. With further reference to FIG. 15, mount 98 is preferably aligned with and coupled to the extensible members of connector 24 so as not to impede slidable engagement, one with the other, or with stationary frame 20 and movable frame 22.

Changes and modifications to the present invention may be made without departing from the invention in its broader aspects. Therefore, the embodiments illustrated in FIGS. 13–15 can be considered and utilized in light of the features otherwise described, shown, or reasonably inferred from FIGS. 1–12 and the accompanying description. The appended claims are intended to cover all such variations, changes and modifications Supine chair 10, 140 and other embodiments, along with their component parts and mechanisms, can be made using a variety of commercially available materials and methods well-known to those in the art. In preferred embodiments, the structural and support features of chair 10 are constructed from northern hardwood and/or plywood. All permanent joints can be accomplished with readily available furniture adhesives and/or doweled construction. In highly preferred embodiments, the frame is wrapped with a ½" firm virgin polyurethane foam locked into place by adhesive sprayed between the foam and the polypropylene sheeting, then completely upholstered. Machine screws can be used to attach the arm/leg assemblies to the chair mechanism.

The frame for back rest 14 and/or 142 is preferably made from northern hardwood, employing mortise and tenon construction. For optimum performance, all straight rail tenons are minimally ¾" long and ½" thick, and mortise and tenon fit tolerances should not exceed about 0.007 inches. The frame is covered with a polypropylene webbing fastened over the frame. A coil box spring covers the webbing with all springs tied together. A wire mesh is woven through polypropylene sheeting and is the insulator over the spring deck. Foam filling material is 1½" soft virgin polyurethane foam locked into place by adhesive sprayed between the foam and the polypropylene sheeting. The head end of back rest 14 and/or 142 preferably has an extra ½" foam serving as a headrest/pillow.

The frame for seat 12 and/or 146 is preferably made from northern hardwood, employing mortise and tenon construction, as described above. Sinuous steel springs (10½ gauge) span the set frame with a coil box spring over the sinuous springs. Wire woven polypropylene, as described above, covers the spring deck, in preferred embodiments. Foam filling material is 1½" medium soft virgin polyurethane foam locked into place by adhesive sprayed between the foam and the polypropylene sheeting.

Covers for back rest 14 and/or 142, seat 12 and/or 146, and interposable support member 16 are, preferably, removable to allow for replacement, repair, and/or cleaning, as necessary. The same components and arm rests 18 are completely removable from the corresponding frame or connector for cleaning, maintenance or movement through narrow doors or hallways. In particular, the arm rests can be removed and replaced without interfering with the movement of connector 24 with respect to either stationary frame 20 or movable frame 22.

The mechanism of chair 140 or 10, including connector 24 and movable frame 22, are preferably made from a hardwood with self-lubricating plastic laminate, both of which are attached one to another and to the chair frame with appropriate furniture adhesives and/or machine screws. Various self-lubricating, friction resistant plastics are commercially available and suitable for use as a laminate or base material for the extensible components of the present invention. One material found to perform well is available from Polymer Corp. under the ACETRON GP trademark/trade designation. In highly-preferred embodiments of the present invention and as described in conjunction with FIG. 3B, linear rectangular rails of ACETRON GP can be secured in a complementary-shaped groove configured in an extensible member. A preferred rail orientation provides two sides of the rail extending, past the extensible member, to an apex for slidable engagement with a corresponding extensible member, also made of such material, configured to include a complementary track member.

Figure 5:
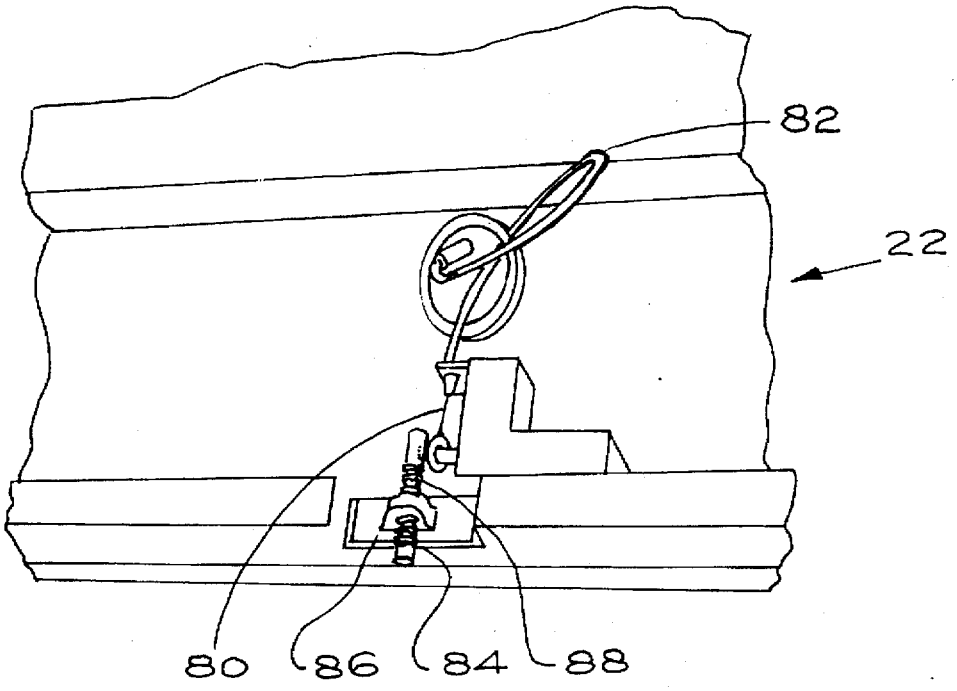
FIG. 5 is an elevated view of an accuator assembly of the type usable to release and/or extend a chair or mechanism of the present invention.

With reference to FIG. 10B and preferred embodiments, an actuator handle located on the back side of back rest 14 and/or 142 and preferred embodiments activates the release of the mechanism consisting of spring plungers with pulleys and cables located within the frame of the back. With reference to FIG. 5, an actuator handle located in the front base panel, operated by a cable, activates the seat in a similar fashion. As described above, other devices and/or assemblies can be employed to initiate movement of frame 22. As described above, seat portion 12 pulls out horizontally revealing a mid-support cushion, which in preferred embodiments consists of 4¼" thick medium soft virgin polyurethane foam covered with matching upholstery.

In highly preferred embodiments, the chair of the present invention meets or exceeds the frame retardancy requirements of California Technical Bulletin 133, as well as those of Port Authority of New York, the State of New Jersey, and the City of Boston Fire Code.

It will be appreciated by those skilled in the art that the materials used in the construction of the extendable chair and mechanism of the present invention and the dimensions used in the various components thereof will be selected for a particular use situation. Although several specific configurations of the inventive chair and mechanism have been illustrated and described, those skilled in the art will appreciate that alternate configurations can be utilized.

While the principles of this invention have been described in connection with specific embodiments, it should be understood clearly that these descriptions are made only by way of example and are not intended to limit the scope of the invention, in any manner. For example, various other mechanisms can be used in conjunction with the backrest and movable frame components of a preferred embodiment to lengthen or otherwise extend the longest dimension of the supine rest surface. These various other mechanisms may be associated with additional features which do not detract from the aesthetics of a chair article in an upright position. For instance, a backrest supinely positioned can be further extended through use of a pivotable surface releasable from the anterior portion of the backrest and supported by a collapsible leg member concealed thereunder. Likewise, while a number of non-coplanar extensible members have been shown in conjunction with a connector of the mechanism and chair articles of the present invention, alternate configurations are possible whereby the number of non-coplanar extensible members is increased, thereby providing for a supine rest surface having a longer dimension. Other advantages and features of the invention will become apparent from the claims hereinafter, with the scope of the claims determined by the reasonable equivalents as understood by those skilled in the art.

We claim:

1. A mechanism for use with chairs having a seat and back rest extendable to a sleeping position and retractable to a sitting position, said mechanism comprising:

a substantially stationary frame having an interior cross dimension;

a frame linearly movable from said stationary frame and having a structural height dimension and an exterior cross dimension less than said stationary frame interior cross dimension;

a connector coupling said stationary and movable frames, said connector having a plurality of non-coplanar extensible members, one said extensible member slidably engaging said stationary frame and another said extensible member slidably engaging said movable frame and having a structural height dimension less than said height dimension of said movable frame;

a member on said one extensible member to stop slidable engagement of said connector with said movable frame; and a member on said another extensible member to stop slidable engagement of said connector with said stationary frame.

2. The mechanism as defined in claim 1 wherein said extensible members comprise two pairs of interengaging linear members.

3. The mechanism as defined in claim 2 wherein each interengaging linear member of said pair slidably engages the other linear member.

4. The mechanism as defined in claim 3 wherein each linear member of each said pair has a complementary track member for slidable engagement with the other linear member.

5. The mechanism as defined in claim 4 wherein one complementary track member receives the other complementary track member, said receptive track member having vertically aligned portions dimensioned to receive said other track member.

6. The mechanism as defined in claim 3 wherein said interengaging linear members are juxtaposed one to the other.

7. The mechanism as defined in claim 6 wherein each linear member of each pair slidably engages the other linear member.

8. The mechanism as defined in claim 7 wherein one linear member of each pair slidably engages said stationary frame, and one linear member of each pair slidably engages said movable frame.

9. The mechanism as defined in claim 2 wherein one interengaging linear member of each said pair slidably engages said stationary frame, and one interengaging linear member of each said pair slidably engages said movable frame.

10. The mechanism as defined in claim 9 wherein each linear member of each of said pair has a track member for slidable engagement with one of said stationary and movable frames.

11. The mechanism as defined in claim 9 wherein said movable frame comprises a pair of sidewalls, each said sidewall having vertically aligned portions dimensioned to receive said linear member.

12. The mechanism as defined in claim 11 wherein said sidewalls are interposable between said stationary frame and said connector upon retracting said mechanism.

13. An extendable chair, comprising:

a seat member and a back rest member, said back rest member movable between sitting and substantially horizontal positions;

a stationary frame having an interior cross dimension;

a movable frame having an exterior cross dimension less than said stationary frame interior cross dimension and linearly separable from said stationary frame; and a connector linearly coupling said stationary and movable frames and linearly extendable from said stationary frame, said connector having a plurality of non-coplanar extensible members, one said extensible member slidably engaging said stationary frame and another said extensible member slidably engaging said movable frame, such that said movable frame is positioned between said stationary frame and said connector when said chair is upright.

14. The chair as defined in claim 13 wherein said extensible members comprise two pairs of interengaging linear members.

15. The chair as defined in claim 14 wherein one linear member of said pair slidably engages the other linear member.

16. The chair as defined in claim 15 wherein one interengaging linear member of each pair slidably engages said stationary frame, and one interengaging linear member of each pair slidably engages said movable frame.

17. The chair as defined in claim 16 wherein:

said stationary member comprises a pair of spaced sidewalls; and said seat member is mounted to said movable frame, each of said seat member and movable frame having a unit dimension less than the interior cross dimension of said stationary frame.

18. The chair as defined in claim 13 wherein said back rest member is pivotally attached to said connector such that said back rest member is substantially co-planar with said seat member upon movement of said chair from upright to horizontal positions.

19. The chair as defined in claim 18 wherein said back rest member is positioned co-planar with said seat member by locking engagement with said connector.

20. An extendable chair, comprising:

a seat and a back rest member movable between sitting and substantially horizontal positions;

a stationary frame having an interior cross dimension;

a movable frame having a structural height dimension and an exterior cross dimension less than said stationary frame interior cross dimension, said movable frame linearly separable from said stationary frame;

a connector slidably engaging said stationary and movable frames and linearly extendable from said stationary frame, said connector non-coplanar with said stationary and movable frames and having a structural height dimension less than said height dimension of said movable frame; and an attachment member pivotally coupling said connector and said back rest member, such that upon extending said connector said back rest member is horizontally positionable.

21. The chair as defined in claim 20 wherein said connector engages each of said stationary and movable frames with two pairs of complementary track members.

22. The chair as defined in claim 21 wherein one pair of track members slidably engages said stationary frame, and the other pair of track members slidably engages said movable frame.

23. The chair as defined in claim 20 wherein:

said stationary frame comprises a pair of spaced sidewalls; and said seat is mounted to said movable frame, each of said seat and movable frame having a unit dimension less than the interior cross dimension of said stationary frame.

24. The chair as defined in claim 20 wherein said attachment member further includes a locking assembly to positionally secure said back rest member.

* * * * *